US008749436B2

(12) United States Patent
Yabe

(10) Patent No.: US 8,749,436 B2
(45) Date of Patent: Jun. 10, 2014

(54) MOBILE WIRELESS DEVICE

(75) Inventor: Shintaro Yabe, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 510 days.

(21) Appl. No.: 13/070,199

(22) Filed: Mar. 23, 2011

(65) Prior Publication Data

US 2011/0234459 A1 Sep. 29, 2011

(30) Foreign Application Priority Data

Mar. 26, 2010 (JP) ..... 2010-071350

(51) Int. Cl.
*H01Q 1/24* (2006.01)

(52) U.S. Cl.
USPC ..... 343/702

(58) Field of Classification Search
USPC ..... 343/702
See application file for complete search history.

(56) References Cited

U.S. PATENT DOCUMENTS 6,861,464 B2 * 3/2005 Eadara et al. ..... 524/502
2008/0156057 A1 * 7/2008 Lin et al. ..... 72/112

FOREIGN PATENT DOCUMENTS

JP 2001-510289 A 7/2001
JP 2005-178745 A 7/2005
JP 2006-157206 6/2006
WO 99/03167 A1 1/1999

OTHER PUBLICATIONS

Non-Final Office Action dated Jan. 21, 2014 issued by the Japanese Patent Office for Japanese Patent Application No. 2010-071350.

* cited by examiner

*Primary Examiner* — Kristy A Haupt

(57) ABSTRACT

A mobile wireless device and method are disclosed. A circuit board is located in a housing, and antenna element means is adhered to an internal surface of the housing by an electrically conductive rubber member comprising adhesive agent means. A power input terminal is located on the circuit board and electrically coupled to an end of the electrically conductive rubber member.

20 Claims, 6 Drawing Sheets

MOBILE WIRELESS DEVICE

CROSS-REFERENCE TO RELATED APPLICATION

The present application claims priority under 35 U.S.C. §119 to Japanese Patent Application No. 2010-071350, filed on Mar. 26, 2010, entitled "MOBILE WIRELESS DEVICE". The content of which is incorporated by reference herein in its entirety.

FIELD

Embodiments of the present disclosure relate generally to mobile wireless devices, and more particularly relate to a mobile wireless device comprising an antenna element.

BACKGROUND

Mobile wireless devices comprise an antenna element (antenna radiation element) for wireless communication. Conductor lines, coils, or conductor plates may be built into molded parts of an insulating material, and the antenna is attached to a housing via the molded parts. Alternatively, the conductor lines, coils, or conductor plates are attached to the housing through integral molding with the housing and are retained in the housing.

A mobile wireless device having a reader/writer function may comprise conductive rubber packing, which serve as an antenna circuit for the reader/writer function, at a joint section of the housing of the mobile information device. As a result, there may be many restrictions on arrangement positions and methods for forming an antenna circuit. Consequently, there is need for a mobile wireless device comprising an antenna element that conserves space inside the housing with less positional restrictions.

SUMMARY

A mobile wireless device and method are disclosed. A circuit board is located in a housing, and an antenna element means is adhered to an internal surface of the housing by an electrically conductive rubber member comprising an adhesive agent. A power input terminal is located on the circuit board and electrically coupled to an end of the electrically conductive rubber member. In this manner, the antenna element means conserves space inside the housing with fewer positional restrictions.

In an embodiment, a mobile wireless device comprises a circuit board located in a housing, and antenna element means is adhered to an internal surface of the housing by an electrically conductive rubber member comprising adhesive agent means. A power input terminal is located on the circuit board and electrically coupled to an end of the electrically conductive rubber member.

In another embodiment, a mobile wireless device comprises rubber member means comprising a conductive rubber operable to function as an antenna element, and adhesive agent means. A circuit board comprising a feed terminal electrically coupled to one end of the rubber member means via the adhesive agent means.

In yet another embodiment, a method provides an antenna. A circuit board is provided and located in a housing, and an antenna element is adhered to an internal surface of the housing by an electrically conductive rubber member comprising an adhesive agent. A power input terminal is located on the circuit board, and the power input terminal is electrically coupled to an end of the electrically conductive rubber member.

BRIEF DESCRIPTION OF THE DRAWINGS

Embodiments of the present disclosure are hereinafter described in conjunction with the following figures, wherein like numerals denote like elements. The figures are provided for illustration and depict exemplary embodiments of the present disclosure. The figures are provided to facilitate understanding of the present disclosure without limiting the breadth, scope, scale, or applicability of the present disclosure. The drawings are not necessarily made to scale.

DETAILED DESCRIPTION

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure are described herein in the context of one practical non-limiting application, namely, a mobile wireless device such as a mobile phone. Embodiments of the disclosure, however, are not limited to such mobile phone, and the techniques described herein may be utilized in other applications. For example, embodiments may be applicable to digital books, digital cameras, electronic game machines, digital music players, personal digital assistance (PDA), automated teller machines (ATM), personal handy phone system (PHS), lap top computers, TV's, Global Positioning Systems (GPS's) or navigation systems, machining tools, pedometers, health equipments such as weight scales, display monitors, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
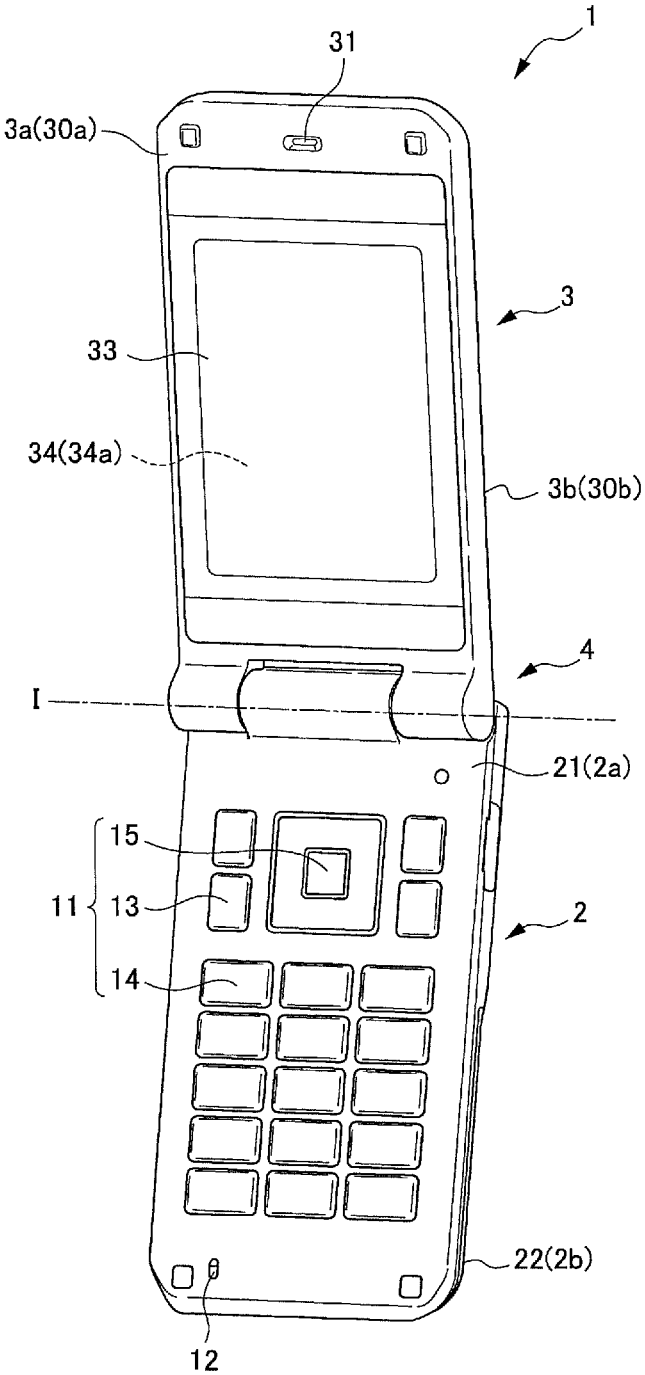
FIG. 1 is an illustration of an exemplary external view of a mobile wireless device in an open state according to an embodiment of the disclosure.

FIG. 1 is an illustration of an exemplary external view of a mobile phone 1 in an open state according to an embodiment of the disclosure. Although a mobile phone 1 is shown as being a folding mobile phone in FIG. 1, the mobile phone 1 may be of a sliding type, a rotating type, a straight type, or the like. In the sliding type, starting from a state in which a first housing 2 and a second housing 3 are layered over one another, one housing is slid in one direction. In the rotating type, one housing is rotated using an axis line along the direction in which the first housing 2 and the second housing 3 are layered over one another. In the straight type, the first housing 2 and the second housing 3 are arranged in a single housing and there is no connection part.

The folding mobile phone comprises a roughly cuboid-shaped operating-part-side housing (first housing) 2, the roughly cuboid-shaped display-part-side housing (second housing) 3, and the connection part 4 that connects the first housing 2 and the second housing 3. The upper end of the first housing 2 and the lower end of the second housing 3 can open and close via the connection part 4.

The connection part 4 is positioned on one end of the first housing 2, and couples the second housing 3 so that the first housing 2 and the second housing 3 can move relative to each other. Specifically, the connection part 4 couples the second housing 3 and the first housing 2 so that they can be opened and closed around an opening and closing axis l through a center of the connection part 4. When the first housing 2 and the second housing 3 are rotated (turned) away from each other, the mobile phone 1 is modified into an open state in which the first housing 2 and the second housing 3 are mutually open (FIG. 1). Conversely, when the first housing 2 and the second housing 3 are rotated (turned) toward each other, the mobile phone 1 is modified into a closed (folded) state in which the first housing 2 and the second housing 3 are folded together (not shown).

The first housing 2 comprises a front case 21 and a rear case 22 that forms an outer shell. The front case 21 comprises the front surface 2*a* of the first housing 2. The front surface 2*a* of the first housing 2 faces the second housing 3 when the mobile phone 1 is in the folded state. The rear case 22 comprises a rear surface 2*b* located opposite to the front surface 2*a* in the first housing 2.

The front case 21 comprises operating-key groups 11, which are exposed on the front surface 2*a*. The operating-key groups 11 comprises function-setting operating keys 13, input operating keys 14, selection operating keys 15, and the like. The function-setting operating keys 13 can activate various settings or various functions such as an address-book function or an E-mail function. The input operating keys 14 may comprise a keypad and can input numbers such as telephone numbers, characters and the like for e-mails, or the like. The selection operating keys 15 can make selections for various operations such as vertical and horizontal scrolling, or the like.

Each of the keys configuring the operating-key groups 11 are assigned (key assignment) prescribed functions depending on the open/closed state of the first housing 2 and the second housing 3, or the type of application being activated. In the mobile phone 1, when a user presses one of the keys configuring the operating-key groups 11, operations corresponding to the functions assigned to the key are executed.

The front surface 2*a* of the first housing 2 comprises an audio input part 12 into which audio emitted by the user of the mobile phone 1 during a call is inputted. The audio input part 12 is positioned near an end (lower end) opposite to the connection part 4 in a longitudinal direction of the first housing 2.

Side surfaces of the first housing 2 may comprise an interface, a headphone/microphone element, an interface for a detachable external memory, a charging element for charging the battery, and the like. The interface sends/receives data with an external device (host device).

The second housing 3 comprises a front case 30*a*, a cover member 33, and an rear case 30*b* that form an outer shell. The front case 30*a* and the cover member 33 configure the front surface 3*a* of the second housing 3. The front surface 3*a* of the second housing 3 faces the first housing 2 when the mobile phone 1 is in a folded state. The rear case 30*b* configures the rear surface 3*b* that is the surface opposite to the front surface 3*a* in the second housing 3.

A main liquid-crystal display module 34 that displayed various data is arranged inside the second housing 3. A main display part 34*a* is provided on one surface of the main liquid-crystal display module 34. The main display part 34*a* is visible from a side of the front surface 3*a* of the second housing 3 via a completely or partially transparent cover member 33.

The front case 30*a* comprises an audio output part 31 therein that outputs audio from the other party of a call. The audio output part 31 is arranged on the end opposite from the connection part 4 in the longitudinal direction of the second housing 3.

The front case 21 and rear case 22 of the first housing 2, the front case 30*a*, cover member 33, rear case 30*b* of the second housing 3, and the like, may comprise resin.

Figure 2:
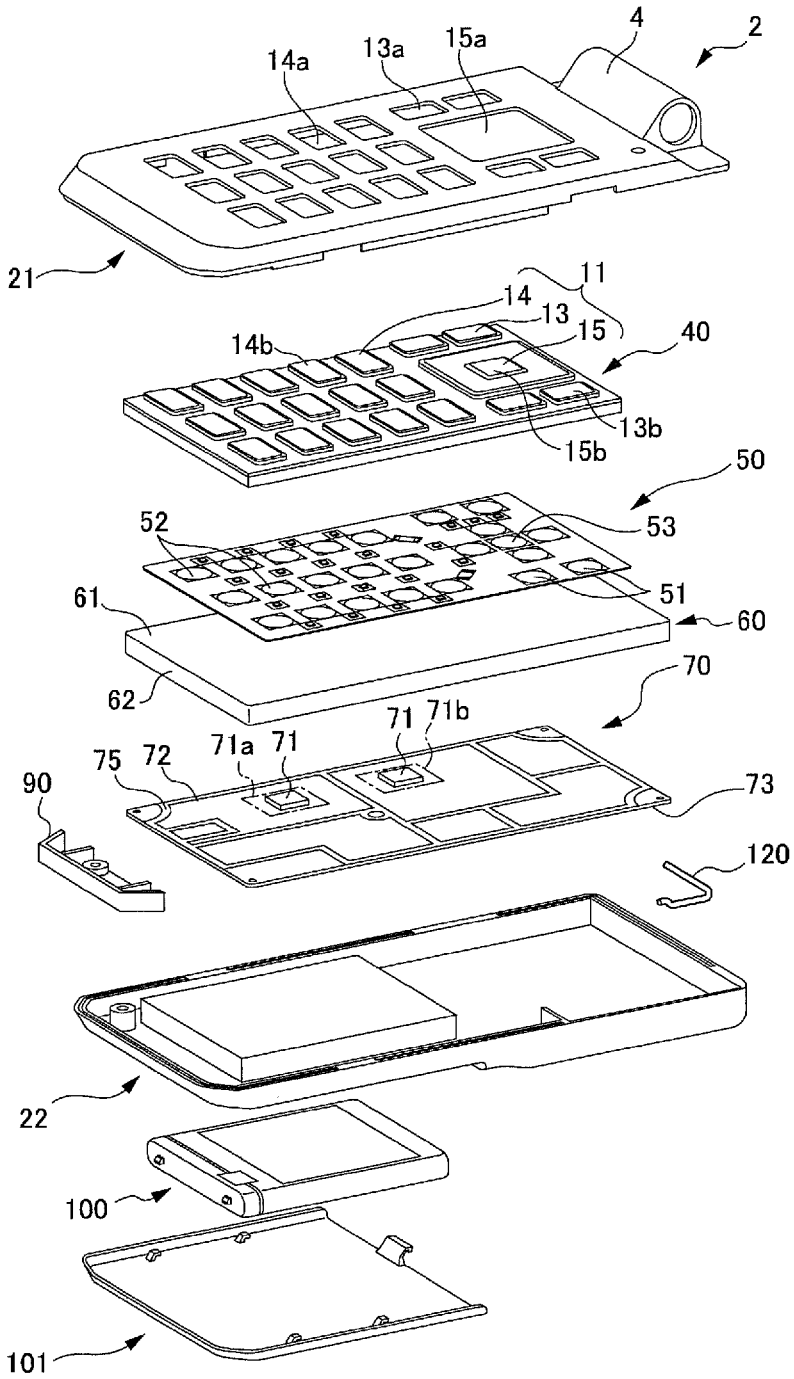
FIG. 2 is an illustration of an exploded view of the mobile wireless device shown in FIG. 1 showing parts in a first housing.
Figure 3:
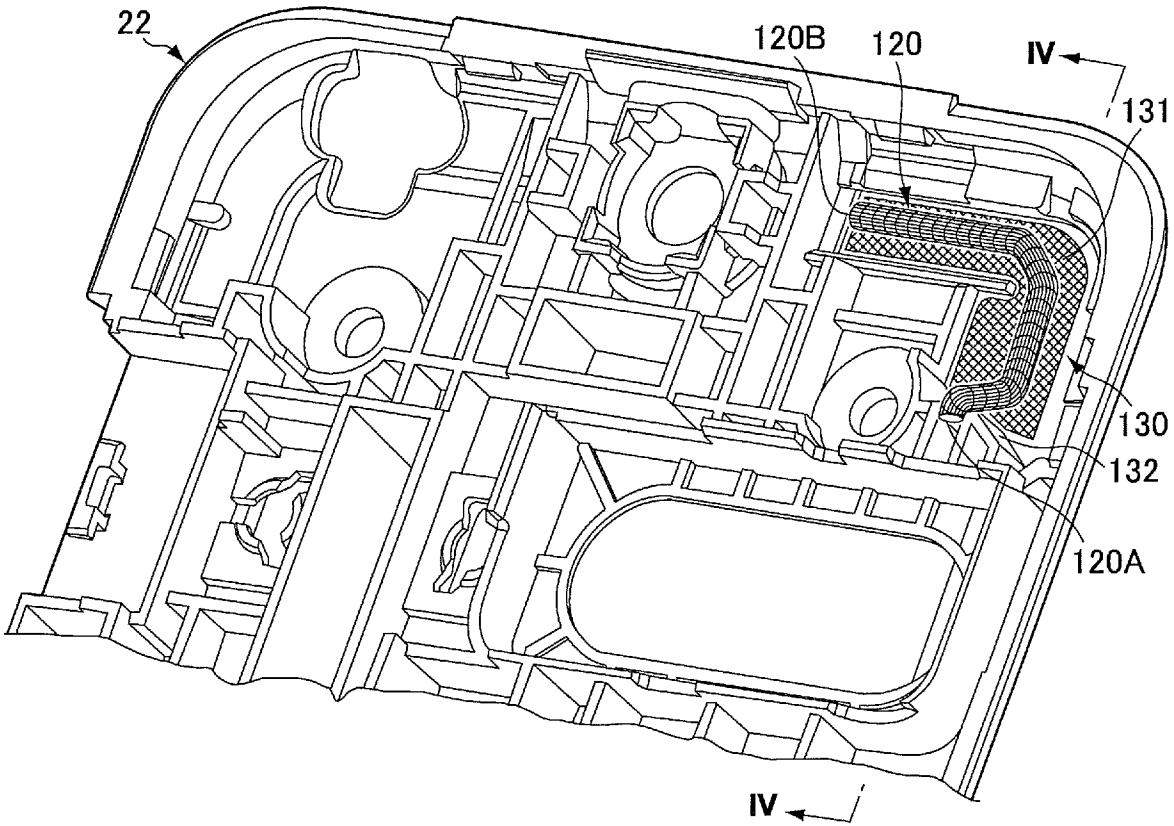
FIG. 3 is an illustration of a partial enlarged perspective view of the first housing shown in FIG. 2 in a state in which a front case is removed and a rubber member is exposed.
Figure 4:
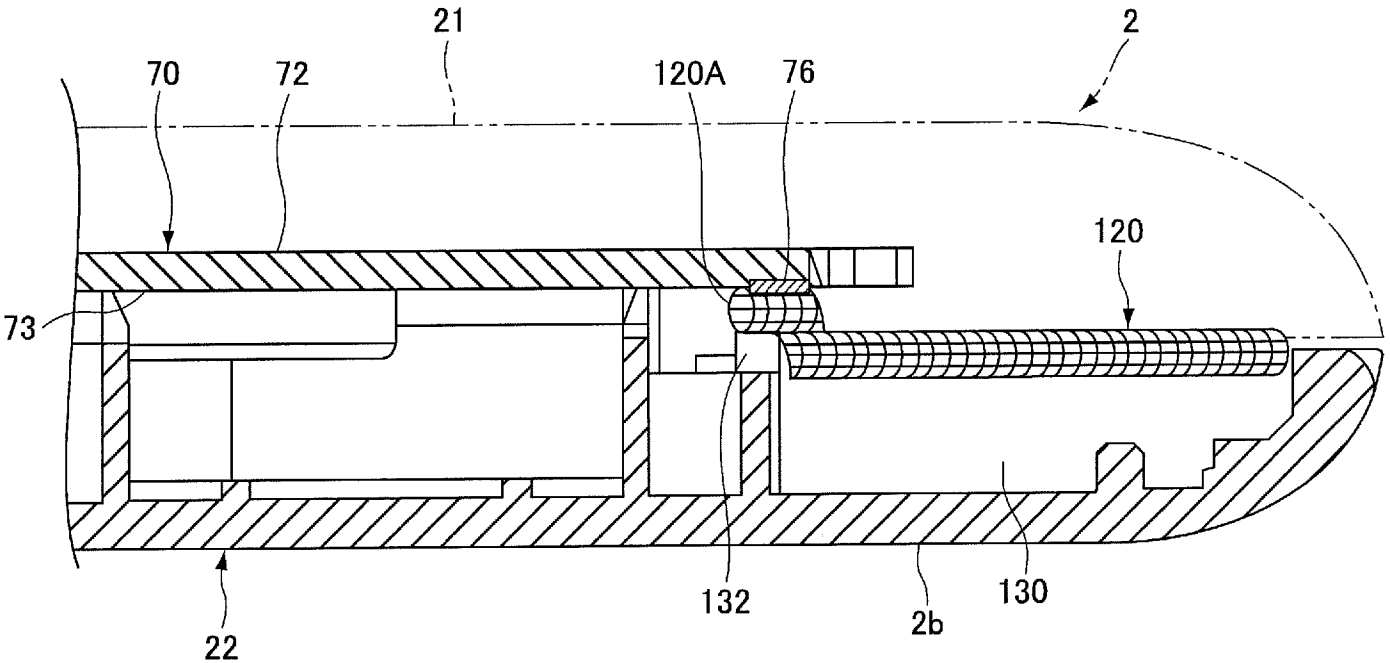
FIG. 4 is an illustration of a cross-sectional view along the line IV-IV shown in FIG. 3.

FIG. 2 is an illustration of an exploded view of the mobile wireless device shown in FIG. 1, showing parts built into the mobile phone 1. FIG. 3 is an illustration of a partial enlarged perspective view of the first housing 2 shown in FIG. 1 in a state in which the front case 21 is removed and a rubber member 120 is exposed. FIG. 4 is an illustration of a cross-sectional view along a line IV-IV shown in FIG. 3.

The front case 21 and the rear case 22 are arranged such that their respective concave inner surfaces face each other, and are joined such that their respective peripheral borders overlap each other. Moreover, a key structure part 40, a key substrate 50, a shield case 60, a circuit board 70, a main antenna 90, and a rubber member 120 that functions as an antenna element of a sub-antenna are operable to be wedged between the front case 21 and the rear case 22. In FIG. 2, an interior configuration of the rear case 22 is shown in a simplified form. The antenna element, the main antenna 90, and/or the rubber member 120 may each comprise, for example but without limitation, a three-dimensional configuration, and the like.

The front case 21, comprises keyholes 13*a*, 14*a*, and 15*a* formed on an inner surface of the front case 21 and facing the main display part 34*a* of the second housing 3 in the closed state of the mobile phone 1. The pressing surfaces of function-setting-operating-key members 13*b* configuring the function-setting operating keys 13 are exposed from each of the keyholes 13*a*, 14*a*, 15*a*. Also, the pressing surfaces of input-operating-key members 14*b* configuring the input operating keys 14, and the pressing surfaces of selection-operating-key members 15*b* configuring the selection operating keys 15 are exposed from each of the keyholes 13*a*, 14*a*, 15*a*. When the pressing surfaces of the function-setting-operating-key members 13*b*, the input-operating-key members 14*b*, and the selection-operating-key members 15*b* are pressed, a peak of a metal dome provided on each of the corresponding key switches 51, 52, 53 is pressed. When pressed, the peak of the metal dome comes into contact with a switch element to perform electric conduction as explained in more detail below.

The key substrate 50 is a flexible substrate formed by wedging wiring between multiple insulating layers (insulating film). The key substrate 50 is placed on a plate section 61 (described below) in a shield case 60. The key substrate 50 comprises the multiple key switches 51, 52, 53 formed on the side of the key structure part 40. The key switches 51, 52, 53 each have a metal dome that comprises a metal sheet that is three-dimensionally formed in a curved bowl-like shape. The metal dome is configured so that when the peak of the bowl-like shape thereof is pressed, the metal dome comes into contact with a switch element formed on an electrical circuit (not shown) pressed on a surface of the key substrate 50 to perform electric conduction.

The key structure part 40 is arranged facing the key substrate 50. The key structure part 40 is configured by providing pushers capable of pressing the multiple key switches 51, 52, 53, and a key top having the pressing surfaces of the operating-key groups 11 on a substrate sheet composed of silicon rubber, and the like that has elasticity. The function-setting operating keys 13, the input operating keys 14, and the selection operating keys 15 configuring the operating-key groups 11 in the key structure part 40 are arranged in positions facing the key switches 51, 52, 53 on the key substrate 50 and are also arranged to be exposed from the keyholes 13*a*, 14*a*, 15*a* formed on the front case 21.

The shield case 60 may be an electrically conductive member with four side walls and one main surface wall. That is, the shield case 60 is a thin rectangular parallelepiped container with one main surface, thereof removed to provide an opening. The shield case 60 comprises the plate section 61 which is a surface on which the key substrate 50 is placed, and a rib 62 formed approximately vertically on a surface on a side of the opening in the plate section 61. The rib 62 is formed to be equivalent or sufficiently taller than the height of the tallest electronic component from among the various electronic components mounted on the circuit board 70. The rib 62 is formed on the peripheral border and inner side of the plate section 61 in a manner corresponding to a reference-potential pattern layer 75 configuring a reference-potential part of the circuit board 70. Specifically, the rib 62 is, without limitation, formed to be arranged above the reference-potential pattern layer 75 when the shield case 60 is placed on the circuit board 70.

When a bottom face of the rib 62 is placed into contact with the reference-potential pattern layer 75, the shield case 60 is electrically connected to the reference-potential pattern layer 75. The shield case 60 performs electrical conduction with the reference-potential pattern layer 75 and obtains an electric potential equivalent to that of the reference-potential pattern layer 75.

In addition to preventing noise from external high-frequency waves, and the like from acting on the various electronic components arranged on the circuit board 70, the shield case 60 blocks noise emitted from Radio Frequency (RF) circuits, CPU circuits, power supply circuits, and the like, thereby preventing the RF circuits, Central Processing Unit (CPU) circuits, power supply circuits, and the like from acting on other electronic components or receiver circuits, and the like, coupled to an antenna. Specifically, because the bottom face of the rib 62 on the shield case 60 is arranged above the reference-potential pattern layer 75, each circuit is surrounded by the rib 62 and is covered by part of the plate section 61. The rib 62 functions as a dividing wall for each circuit and, along with part of the plate section 61, shields each circuit.

Furthermore, the shield case 60 may be configured entirely from metal, or it may be configured by forming the framework from resin and forming a conductor film on the surface of that framework.

A variety of multiple electronic components 71 and circuits are arranged on a first surface 72 of the circuit board 70. The various electronic components form multiple circuit blocks through prescribed combinations. Analog processing circuit blocks such as a CPU circuit, a reception processing part 71*a* and a transmission processing part 71*b*, various circuit blocks including power supply circuits, and the like may be formed on the circuit board 70.

The reception processing part 71*a* performs wireless communication with an external device (i.e., base station) coupled to a public wireless communication network at a prescribed frequency band for use. Then, the reception processing part 71*a* performs demodulation processing for signals received through a main antenna 90 or an antenna of the rubber member 120, and the like, that functions as the antenna element of the sub-antenna, and supplies processed signals to a CPU circuit. Moreover, the reception processing part 71*a* performs modulation processing for signals supplied from the CPU circuit and sends them to an external device from the main antenna 90 or the rubber member 120. Moreover, the transmission processing part 71*b* may be coupled to a digital television antenna (not shown) and send signals received from the digital television antenna through the main antenna 90 or the rubber member 120 to the CPU.

A reference-potential pattern layer 75 that configures a reference-potential part is also formed on the first surface 72 on the side of the shield case 60 on the circuit board 70, in addition to the above-mentioned various electronic components. The reference-potential pattern layer 75 is formed to partition each of the abovementioned circuit blocks. The reference-potential pattern layer 75 is formed by printing an electrically conductive member on the surface of the first surface 72 of the circuit board 70 in a prescribed pattern.

The main antenna 90 is arranged on an opposite side from the connection part 4 on the first housing 2 (rear case 22). The main antenna 90 is coupled to the circuit board 70 via wiring (not shown).

A detachable battery lid 101 is located on one end of the rear case 22. The battery lid 101 is attached to the rear case 22 after housing a battery 100 from the outer side of the rear case 22. Moreover, a microphone (not shown) of the audio input part 12 for inputting the user's voice is located on one end of the rear case 22.

The rubber member 120 is arranged on the rear case 22 in a region on the side of the connection part 4 as shown FIGS. 3 and 4. The cross-sectional configuration of the rubber member 120 may be, for example but without limitation, circular, roughly circular, elliptical, rectangular, and the like.

The rubber member 120 is formed from a conductive rubber and functions as the antenna element of the sub-antenna. The rubber member 120 comprises an adhesive agent that causes the rubber member 120 to adhere to the inside of the first housing 2 (rear case 22).

Using this adhesive agent, the rubber member 120 is adhered to the inside of the rear case 22. Specifically, the rubber member 120 is adhered to a rubber-member arrangement region 130 on the inside of the rear case 22. The rubber member 120 may also be adhered to inside of various members configuring the housings, such as but without limitation, the front case 21 of the first housing 2, the front case 30*a*, the rear case 30*b* of the second housing 3, and the like. In a direction of thickness of the first housing 2, the rubber-member arrangement region 130 is positioned toward the front case 21 (toward the circuit board 70) rather than toward the rear surface 2*b* of the rear case 22, and is flat.

The rubber-member arrangement region 130 may be formed by a knurling process forming a knurling 131. The knurling process can comprise a process in which nicks that have quadrilateral or roughly serriform cross-sections are formed in a striped or netted pattern when viewed from a planar perspective. By performing the knurling process, a grip may be improved, and consequently, the adhesiveness (adhesive strength) of the rubber-member arrangement region 130 of the rear case 22 and the rubber member 120 is improved.

A pedestal part 132 is provided adjacent to the rubber-member arrangement region 130 on the rear case 22. The pedestal part 132 protrudes more toward the front case 21 (toward the circuit board 70) than the rubber-member arrangement region 130. One end (terminal part) 120A of the rubber member 120 is arranged on the surface of the pedestal part 132 on the side of the circuit board 70. Another end 120B of the rubber member 120 is arranged on the rubber-member arrangement region 130. The rubber member 120 extends in a prescribed configuration in accordance with the antenna element properties. Alternatively, the terminal part 120A may be located on a different plane from a plane comprising the main antenna 90.

The conductive rubber (electrically conductive rubber member) that forms the rubber member 120 comprises a conductive rubber composite. The electrically conductive rubber member comprises a base rubber, a conductive filler, and an adhesive agent.

The base rubber, may comprise, for example but without limitation, silicone resin, modified silicone resin, acrylic resin, chloroprene resin, polysulfide resin, polyurethane resin, polyisobutyl resin, or fluorosilicone resin, and the like.

The conductive filler contained in the base rubber, may have a volume resistivity ranging from $1\times10^{-1}$ Ω·cm or less to $1\times10^{-2}$ Ω·cm or less. As a result, it is easy to make an overall volume resistivity of the electrically conductive rubber member $1\times10^{-1}$ Ω·cm or less.

The conductive filler may comprise, for example but without limitations, ketjen black or acetylene black, which are each types of conductive carbon black; any carbon material from among graphite, carbon fiber, carbon nanofibers (CNF), or carbon nanotubes (CNT); any metal material from among gold, silver, or platinum; any derivative from among polythiophene, polyacetylene, polyaniline, polypyrrole, polyparaphenylene, or polyparaphenylene vinylene; a conductive high-polymer material in which a dopant (typically an anion or a cation) is added to these derivates; and an ionic liquid that is an organic filler with strong polarity, and the like.

Any particle size and configuration of the conductive filler suitable for maintaining conductivity may be used. Shape of the conductive filler, may be for example but without limitation, spherical, flake, tree-like, and the like. A rate of content of the conductive filler in the resin may be any rate allowing for the above volume resistivity. The rate of content of the conductive filler, may comprise for example but without limitation, 20 to 50 mass %, and the like.

Any type of adhesive agent suitable for adhering the rubber member 120 to the housing 22 may be used. For example but without limitation, the adhesive agent may comprise, a thermosetting resin such as an epoxy resin or a phenol resin, or a thermoplastic resin. The adhesive agent also comprises urethane resin, silicone resin, acrylic resin, or the like. Furthermore, the adhesive agent can be either a one-component type or a two-component type.

A content rate of the adhesive agent in the rubber member 120 is not particularly limited as long as the rubber member 120 has adhesiveness. In an embodiment, the adhesive agent may be 1 to 60 mass % of the total mass in the conductive rubber.

The adhesive strength of the rubber member 120 may be sufficient for the rubber member 120 to adhere to the rear case 22 and to be maintained even against impact from being dropped. The adhesive strength may allow for detachment using one's hand or a jig.

The rubber member 120 using this type of base rubber has excellent adhesiveness and adhesion with materials used for the housing and the jacket material, including general metal materials, resin materials (polycarbonate, etc.), and rubber materials (polyurethane resin, etc.).

A feed terminal 76 is mounted on a second surface 73 of the circuit board 70 as shown in FIG. 4. The feed terminal 76 is electrically coupled to an RF circuit via the inside of the circuit board 70. Power is fed to the rubber member 120 via the feed terminal 76. In the direction of thickness of the circuit board 70, the feed terminal 76 (power input terminal) is arranged at a position facing the one end 120A of the rubber member 120, and it is electrically coupled to the one end 120A of the rubber member 120. Furthermore, the direction of thickness of the circuit board 70 roughly matches the direction of thickness of the operation-part-side housing 2.

The distance between a surface of the pedestal part 132 of the rear case 22 on the side of the circuit board 70 and the feed terminal 76 of the circuit board 70 is slightly thinner than the thickness of the one end 120A of the rubber member 120. For this reason, it is possible to wedge the one end 120A of the rubber member 120 between the surface of the pedestal part 132 on the side of the circuit board 70 and the feed terminal 76 of the circuit board 70. Then, in this state, a biasing force (reactive force) caused by the elasticity of the conductive rubber is generated in the one end 120A of the rubber member 120. By coming into contact with the one end 120A of the rubber member 120, the feed terminal 76 (power input terminal) electrically couples the circuit board 70 and the rubber member 120. Because the conductive rubber forming the rubber member 120 has elasticity, the rubber member 120 (electrically conductive rubber member) and the feed terminal 76 are in contact in a mutually pressing state due to the biasing force caused by the elasticity of the conductive rubber.

Using a discharge device that can linearly discharge conductive rubber that is a raw material of the rubber member 120, by discharging conductive rubber from the discharge device on the rubber-member arrangement region 130 of the rear case 22, the rubber member 210 can be formed in a prescribed configuration on the rubber-member arrangement region 130.

Accordingly, it is easy to manufacture the antenna element and load it on the housing. In this manner, a space occupied by the antenna element can be reduced. In addition, it is possible to provide a mobile electronic/wireless device with few restrictions on the arrangement position or the method of formation of the antenna element.

In contrast to a case in which the antenna element is formed using a special-purpose mold, it is possible to eliminate the need for a special-purpose mold for casting the antenna element, reducing manufacturing and management costs for the special-purpose mold. Because it is possible to eliminate the need for members or space for retaining and mounting the antenna element, this is advantageous for downsizing the mobile phone 1 (mobile wireless device) or internalizing the antenna into the first housing 2.

Further, it is possible to eliminate a need for a special-purpose feed terminal having a spring member for improving the connectivity of the antenna element and the feed terminal, and the durability and reliability in relation to shocks, pressure, twisting, and the like applied to the mobile phone (mobile wireless device) are excellent. Because of the rubber member 120, the antenna element can be provided inside the first housing 2 or on the circuit board 70 with no particular restrictions. For this reason, there is a high degree of freedom for the arrangement position and method of formation of the antenna element.

The rubber member 120 and the feed terminal 76 may be in contact in a mutually pressing state due to the biasing force caused by the elasticity of the conductive rubber. Consequently, it is easy to maintain the electric connection between the rubber member 120 and the feed terminal 76.

As mentioned above, the region (rubber-member arrangement region 130) of the rear case 22 of the first housing 2 on which the rubber member 120 is adhered may be formed by a knurling process. Therefore, it is possible to improve the adhesiveness (adhesive strength) of the rubber member 120 and the rubber-member arrangement region 130.

Figures 5A, 5B:
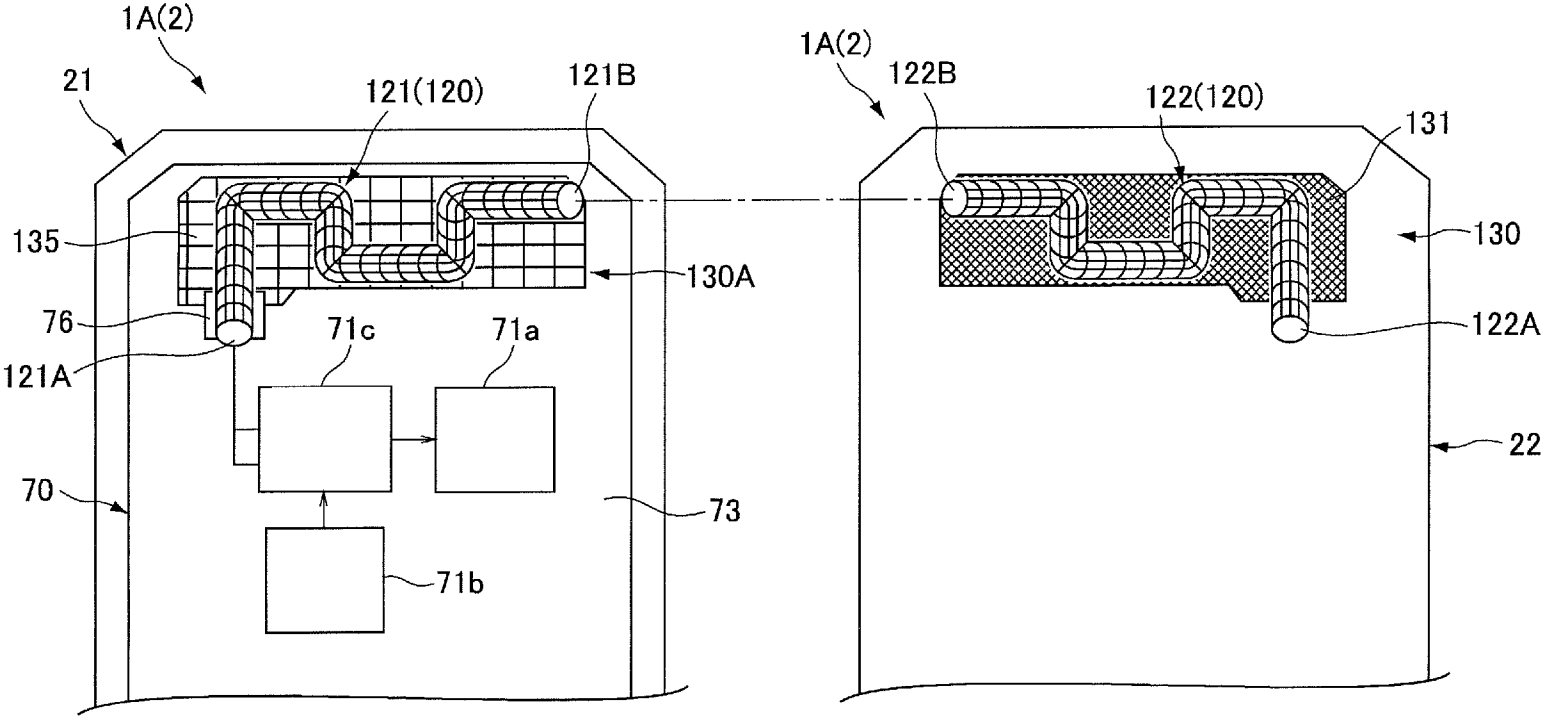
FIGS. 5A and 5B are illustrations of a mobile wireless device showing the front case and the rear case in a virtual opened state according to an embodiment of the disclosure.

FIGS. 5A and 5B are illustrations showing the front case 21 and the rear case 22 of the first housing 2 of a mobile electronic device 1A in a virtual opened state. FIG. 5A shows a side of the front case 21. FIG. 5B shows a side of the rear case 22. Embodiments shown in FIGS. 5A and 5B may have functions, material, and structures that are similar to the embodiments shown in FIGS. 1-4. Therefore common features, functions, and elements may not be redundantly described here.

Compared to the embodiments shown in FIG. 1-4, the rubber member 120 differs from FIG. 1 in that it comprises a first rubber member 121 (first element) that is adhered to the circuit board 70 and a second rubber member 122 (second element) that is adhered to the rear case 22.

In the embodiment shown FIGS. 5A-5B, the first rubber member 121 comprises an adhesive agent for adhering the first rubber member 121 and the second surface 73 of the circuit board 70. The first rubber member 121 is adhered to the second surface 73 of the circuit board 70 using this adhesive agent.

The first rubber member 121 is adhered to the rubber-member arrangement region 130A of the second surface 73 of the circuit board 70. The rubber-member arrangement region 130A is the region of the second surface 73 of the circuit board 70 on which the first rubber member 121 is adhered (arranged). A concavo-convex configuration 135 is formed on the rubber-member arrangement region 130A.

The concavo-convex configuration 135 is formed by using laser machining to partially eliminate the solder resist on the surface of the circuit board 70 (creating a concavo-convex configuration in which parts where the solder resist remains are convex, and parts where the solder resist is eliminated are concave), or by performing machining to form convexes on parts of the surface of the circuit board 70 (creating a concavo-convex configuration in which the original surface of the circuit board 70 is concave, and the parts that have been machined are convex). By forming the concavo-convex configuration 135, it is possible to improve the grip, and the adhesiveness (adhesive strength) of the rubber-member arrangement region 130A of the circuit board 70 and the rubber member 120 can be improved.

As same in the embodiment shown in FIG. 1-4, the rubber-member arrangement region 130 is formed inside the rear case 22 of the first housing 2. The second rubber member 122 is adhered to the rubber-member arrangement region 130 on the inside of the rear case 22. The rubber-member arrangement region 130 is the region of the rear case 22 on which the second rubber member 122 is adhered. The rubber-member arrangement region 130 has undergone a knurling process, and the knurling 133 is formed.

Another end 121B of the first rubber member 121 and another end 122B of the second rubber member 122 face each other. The other end 121B of the first rubber member 121 is positioned at a position closer to the other end 122B of the second rubber member 122 compared to other parts (including the one end 121A) of the first rubber member 121. The other end 122B of the second rubber member 122 is positioned at a position closer to the other end 121B of the first rubber member 121 compared to other parts (including the one end 122A) of the second rubber member 122.

When the front case 21 and the rear case 22 are joined (combined) in the first housing 2, the other end 121B of the first rubber member 121 and the other end 122B of the second rubber member 122 are mutually pressed against each other. Consequently, the other end 121B of the first rubber member 121 and the other end 122B of the second rubber member 122 are electrically connected, and furthermore, the connected state is easy to maintain.

The other parts of the first rubber member 121 and the other parts of the second rubber member 122 are divided from each other. For this reason, the first rubber member 121 and the second rubber member 122 are configured and function as an integrated antenna element that extends in the order of the one end 121A of the first rubber member 121, the other end 121B of the first rubber member 121, the other end 122B of the second rubber member 122, and the one end 122A of the second rubber member 122.

In addition to the abovementioned reception processing part 71*a* and transmission processing part 71*b*, a transmission/reception switching part 71*c* is mounted on the circuit board 70. The transmission/reception switching part 71*c* switches the destination of the feed terminal 76 to the reception processing part 71*a* or the transmission processing part 71*b* during reception processing or transmission processing of wireless communication.

The first rubber member 121 of the rubber member 120 comprises an adhesive agent for adhering the rubber member 120 and the circuit board 70, and it is adhered to the circuit board 70 using this adhesive agent. For this reason, the first rubber member 121 is stably adhered to the circuit board 70, and therefore, it is easy to maintain the electric connection between the one end 121A of the first rubber member 121 and the feed terminal 76.

The other end 121B of the first rubber member 121 and the other end 122B of the second rubber member 122 are electrically connected, and as a result, the first rubber member 121 and the second rubber member 122 function as an integrated antenna element. For this reason, it is possible to extend the effective length of the antenna element formed by the rubber member 120.

The rubber member 120 may also be configured from only the first rubber member 121 adhered to the circuit board 70.

By providing rubber members on the cases forming the housings or on fitted parts in window parts, and the like of the housings (they are also often exposed to the outside), the rubber members can be utilized as (can double as) waterproof packing. Because the rubber members have excellent water resistance, durability against temperature changes, durability against humidity changes, and aging properties, and the like, they are suitable for use as an antenna element provided on parts exposed to the outside of such housings.

Figure 6:
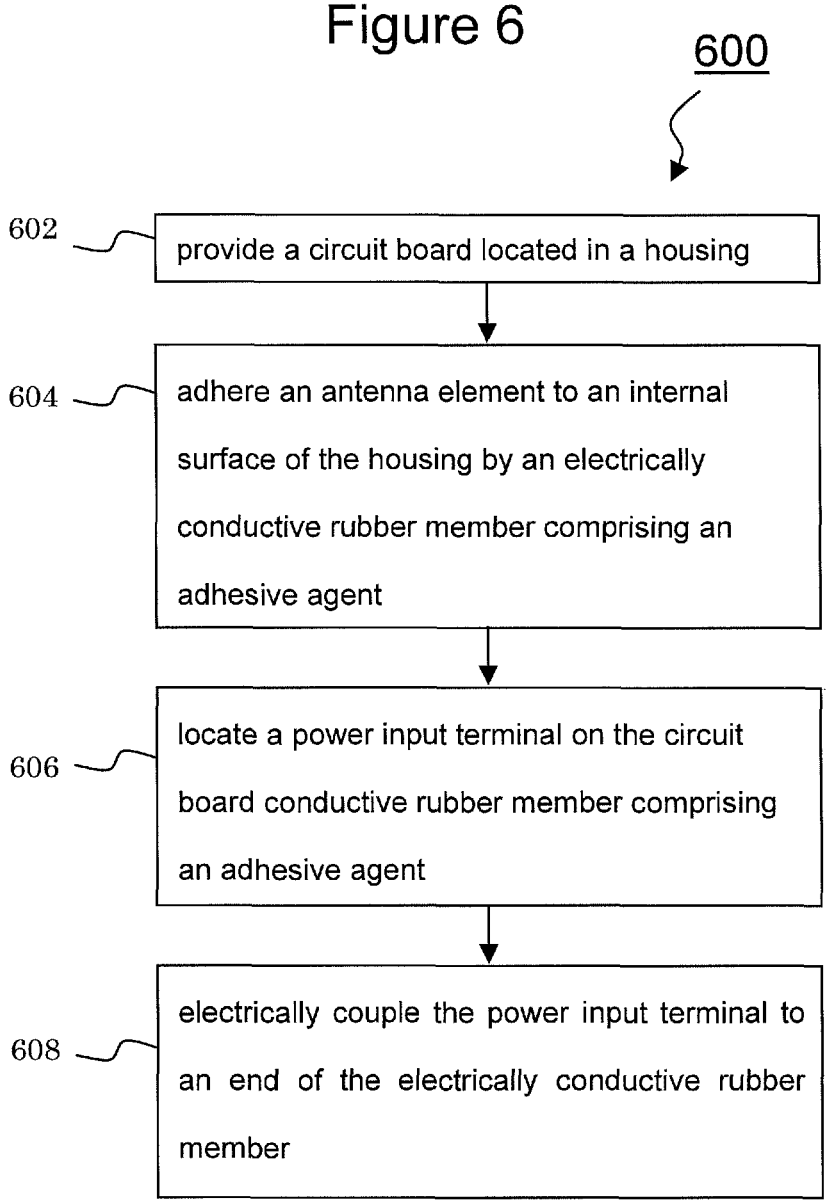
FIG. 6 illustrates an antenna forming process.

FIG. 6 is an illustration of an exemplary flowchart showing an antenna forming process according to an embodiment of the disclosure. The various tasks may be performed in connection with process 600, by software, hardware, firmware, or any combination thereof. It should be appreciated that process 600 may include any number of additional or alternative tasks, the tasks shown in FIG. 6 need not be performed in the illustrated order, and process 600 may be incorporated into a more comprehensive procedure or process having additional functionality not described in detail herein. For illustrative purposes, the following description of process 600 may refer to elements mentioned above in connection with FIGS. 1-5. Process 600 may have functions, material, and structures that are similar to the embodiments shown in FIGS. 1-5; therefore common features, functions, and elements may not be redundantly described here.

Process 600 may begin by providing a circuit board located in a housing (task 602).

Process 600 may continue by adhering an antenna element to the internal surface of the housing by an electrically conductive rubber member comprising an adhesive agent (task 604).

Process 600 may continue by locating a power input terminal on the circuit board (task 606).

Process 600 may continue by electrically coupling the power input terminal to an end of the electrically conductive rubber member (task 608).

In this manner, an antenna element is provided that conserves space inside a housing with fewer positional restrictions.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the present disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A mobile wireless device, comprising:

a circuit board located in a housing;

an antenna element adhered to an internal surface of the housing, the antenna element comprising an electrically conductive rubber material, the electrically conductive rubber material comprising an adhesive agent; and a power input terminal located on the circuit board and electrically coupled to an end of the electrically conductive rubber material.

2. The mobile wireless device of claim 1, wherein the electrically conductive rubber material and the power input terminal are in contact in a mutually pressing state due to a biasing force caused by an elasticity of the electrically conductive rubber material.

3. The mobile wireless device of claim 1, wherein the internal surface of the housing to which the antenna element is adhered is made by a knurling process.

4. The mobile wireless device of claim 1, wherein the electrically conductive rubber material further comprises a base rubber and a conductive filler.

5. The mobile wireless device of claim 1, wherein the adhesive agent comprises a thermosetting resin or a thermoplastic resin.

6. The mobile wireless device of claim 5, wherein the thermosetting resin comprises at least one of the group consisting of: an epoxy resin, and a phenol resin.

7. The mobile wireless device of claim 1, wherein the antenna element comprises a three-dimensional configuration.

8. The mobile wireless device of claim 7, wherein the antenna element further comprises:

a main antenna;

a terminal part located on a different plane from a plane comprising the main antenna; and a connection connecting the main antenna and the terminal part.

9. The mobile wireless device of claim 8, wherein the antenna element further comprises:

a first element located on a first surface of the circuit board; and a second element located on a second surface of the circuit board that is positioned on an opposite side from the first surface, wherein the first element and the second element are electrically coupled.

10. The mobile wireless device of claim 9, wherein the first element and the second element are facing each other.

11. A mobile electronic device comprising:

a self-adhesive rubber member comprising a conductive rubber operable to function as an antenna element, the conductive rubber comprising an adhesive agent; and a circuit board comprising a feed terminal electrically coupled to one end of the self-adhesive rubber member via the adhesive agent.

12. The mobile electronic device of claim 11, wherein the adhesive agent comprises a thermosetting resin or a thermoplastic resin.

13. The mobile electronic device of claim 12, wherein the rubber member comprises a base rubber and a conductive filler.

14. The mobile electronic device of claim 11, wherein volume resistivity of the rubber member is at most $1\times10^{-1}$ Ω·cm.

15. A method for providing an antenna, comprising:

providing a circuit board located in a housing;

adhering an antenna element to an internal surface of the housing, the antenna element comprising an electrically conductive rubber, the electrically conductive rubber comprising an adhesive agent;

locating a power input terminal on the circuit board; and electrically coupling the power input terminal to an end of the electrically conductive rubber.

16. The method of claim 15, further comprising coupling the electrically conductive rubber and the power input terminal in a mutually pressing state due to a biasing force caused by an elasticity of the electrically conductive rubber.

17. The method of claim 15, further comprising forming the internal surface of the housing to which the antenna element is adhered by a knurling process.

18. The method of claim 15, further comprising:

providing a main antenna;

locating a terminal part on a different plane from a plane comprising the main antenna; and coupling the main antenna and the terminal part.

19. The method of claim 18, further comprising:

providing a first element on a first surface of the circuit board;

providing a second element on a second surface of the circuit board that is positioned on an opposite side from the first surface; and electrically coupling the first element and the second element.

20. The method of claim 15, further comprising adhering the antenna element via a thermosetting resin.

* * * * *